United States Patent [19]

Chu

[11] Patent Number: 5,003,707

[45] Date of Patent: Apr. 2, 1991

[54] PORTABLE BOOT DRYING APPARATUS

[76] Inventor: Robert J. Chu, 61-57 84th St., Queens, N.Y. 11379

[21] Appl. No.: 495,367

[22] Filed: Mar. 19, 1990

[51] Int. Cl.[5] ..... F26B 25/00

[52] U.S. Cl. ..... 34/104; 34/243 R

[58] Field of Search ..... 34/104, 90, 91, 21, 34/151, 243 R

[56] References Cited

U.S. PATENT DOCUMENTS

| | | | |
|---|---|---|---|
| 2,076,735 | 4/1937 | Leindorf | 34/104 |
| 2,443,695 | 6/1948 | Russell | 34/104 |
| 2,614,337 | 10/1952 | Darbo | 34/104 |
| 3,154,392 | 10/1964 | Littman | 34/104 |
| 3,645,009 | 2/1972 | Ketchum | 34/104 |
| 3,793,744 | 2/1974 | Saita | 34/104 |
| 4,085,519 | 4/1978 | Masika | 34/104 |
| 4,145,602 | 3/1979 | Lee | 34/104 |
| 4,200,993 | 5/1980 | Blanc et al. | 34/104 |
| 4,768,293 | 9/1988 | Kaffka | 34/104 |
| 4,787,153 | 11/1988 | Chen | 34/104 |

*Primary Examiner*—Henry A. Bennett
*Assistant Examiner*—Denise L. Gromada
*Attorney, Agent, or Firm*—Hopgood, Calimafde, Kalil, Blaustein & Judlowe

[57] ABSTRACT

An accessory apparatus is provided for adaption to receive a flow of heated air from the tubular discharge end of a commercial hair dryer, and to provide therefrom two like divided flows deliverable via flexible tubing to the inner volume of each boot of a given pair of ski boots or other foot wear.

10 Claims, 1 Drawing Sheet

PORTABLE BOOT DRYING APPARATUS

BACKGROUND OF THE INVENTION

The invention relates to apparatus for drying the interior volume of footwear, particularly athletic foot wear such as ski boots, which in the course of a day's use can accumulate moisture, whether from body sweat or from melted snow.

The prior art includes a variety of devices for drying the interior of one or more pairs of ski boots or other foot wear. In U.S. Pat. No. 4,136,464 (Hay), plural rigid upstanding tubes communicate with a plenum chamber which constitutes the base of the device. Each of the tubes has a transversely bent upper end, and an actuating rod is externally exposed above the bend, so that upon placement of an inverted boot over the end of one of the tubes, the weight of the boot actuates the rod, thereby clearing plural openings in the tube for directing warm air from the plenum to the interior of the boot. Heat may be supplied to the plenum by placing the same over a floor register.

U.S. Pat. No. 4,145,602 (Lee) discloses a coin-operated boot-drying/glove-drying apparatus wherein a hot-air blower in a wall-mountable chamber directs drying air to boots or gloves hanging from guide rails, such that an individual horizontal blast of drying air is delivered to each hanging article to be dried.

U.S. Pat. No. 4,171,580 (Vabrinskas) discloses the combination of a housing which completes an airflow passage in the configuration of an inverted U-shape, wherein separate vertical tubes extend into the individual boots of a given pair, and the housing contains a motorized fan to draw inlet air through one tube and to expel the same air via the other tube. The device as a whole hangs from a wall hook, clothes-hanging rod, or the like.

U.S. Pat. No. 4,200,993 (Blanc et al.) discloses floor-mounted apparatus comprising an upstanding tubular column, closed at its base and equipped with a motorized hot-air blower at its upper end. A vertically distributed array of upwardly slanted tubular arms branch from openings in the column and are sized and spaced to provide individual support of ski boots, such that the tilt of each boot allows water drainage to a trough. The troughs are designed to funnel all water to a common means of water accumulation and disposal.

U.S. Pat. No. 4,727,656 (Jannach et al.) discloses an upstanding device wherein a serpentine pipe is the conduit for a flow of warm air. The serpentine course defines a vertically distributed array of upwardly slanted U-bent arms, which are sized and spaced to accommodate individual boots to be dried, via ports in and/or near the bend of each U-shape.

U.S. Pat. No. 4,768,293 (Kaffka) discloses a self-contained unit-handling device for application to a single boot, comprising a motorized fan adapted for support by the upper rim of the boot, and discharging a flow of air via a tube which extends within the boot and which discharges, via an ell, in the toe direction. Air is allowed to exhaust vertically upward between the tube and the inner wall of the boot and via openings in the means of support at the rim of the boot.

All of these prior art devices are cumbersome, requiring a motorized hot-air blower as part of the involved structure. And none of these devices can be truly compact and portable, although the telescoping-tube configuration of Kaffka admittedly provides a degree of collapsability when not in use.

BRIEF STATEMENT OF THE INVENTION

It is the primary object of the invention to provide improved boot (or the like) drying apparatus of utmost simplicity and portability.

It is a specific object to meet the above object as an accessory for use with a portable hair dryer.

The invention recognizes the fact that a portable hair dryer has become, for a great many travellers, an essential item to be packed in one's hand baggage, even in an overnight travel kit. This applies to the ski-enthusiast who, after a day's exertions, wishes to shower and shampoo for the evening. The invention provides an accessory apparatus, adaptable to receive the hot-air discharge from a portable hair dryer, and to then divide the hot-air flow and deliver the same simultaneously to both boots of a given pair. Requisite dry-out ventilation is accomplished in a few minutes, and the accessory apparatus can be flexibly stored without involving noticeable bulk or weight in a travel kit or overnight bag.

DETAILED DESCRIPTION OF THE INVENTION

The invention will be described in detail in conjunction with the accompanying drawings, in which.

Figure 1:
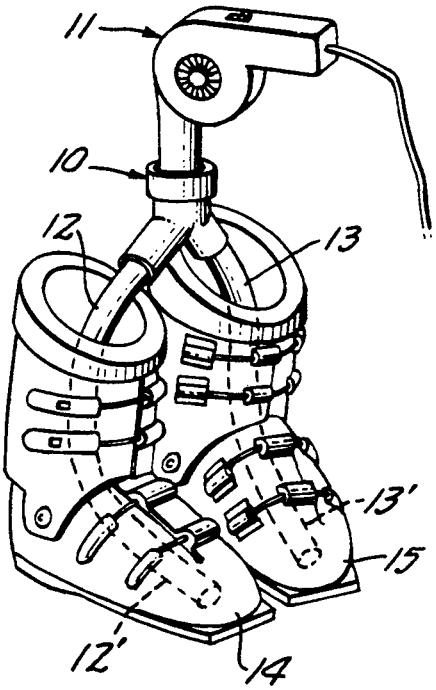
FIG. 1 is a simplified view in perspective, showing the accessory of the invention in use, in conjunction with a portable hair dryer and a pair of ski boots.
Figure 2:
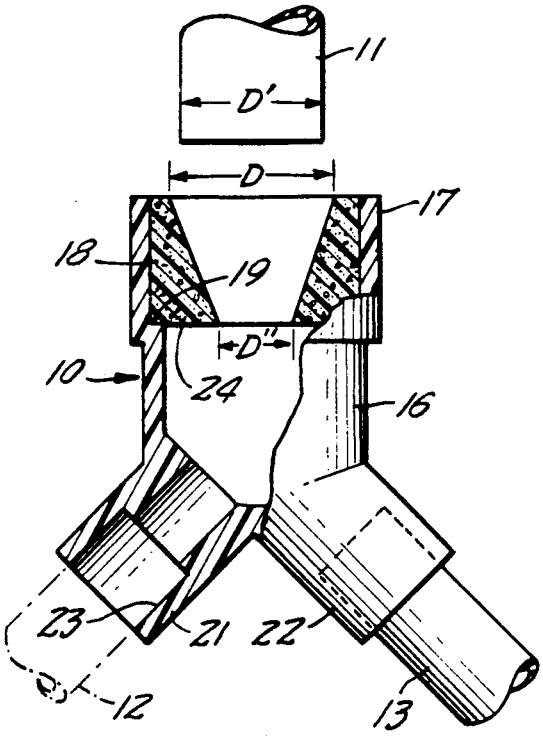
FIG. 2 is an enlarged frangmentary view, partly broken away and in section, to show a first construction of the accessory of FIG. 1.

In FIG. 2, the general designation 10 identifies the accessory of the invention, shown engaged at its upper end to receive the hot-air discharge from a portable hair dryer 11, and positioned to deliver like flows of heated air via separate lengths of flexible tubing 12, 13. Phantom outlines 12', 13' indicate the respective tubing portions within boots 14, 15, and each tube will be understood to have an open end for discharge toward but at some clearance from the toe end of the boot in which it is inserted. The tubing 12, 13 may be of suitable flexible elastomeric material, such as a commercial vinyl, as of 20 mm diameter, and 35 to 40 cm long.

In FIG. 2, the accessory 10 is seen to comprise a "Y" fitting 16, which is preferably a rigid injection-molded plastic product, as of ABS, polypropylene or other suitable material. As shown, the upper end 17 of fitting 16 is of enlarged diameter and is characterized by a counterbore 18 which terminates at an internal shoulder 19, within what may be called the bore of the stem portion 20 of the "Y" configuration. The lower end of stem portion 20 is integrally formed with like branching arms 21, 22 which diverge in the downward direction. Each of the arms 21, 22 is shown with a counterbore 23 which is adapted for frictional reception of the inserted end of one of the flexible tubes 12, 13. An annular insert 24 of compressible material, such as a foamed elastomeric, is shown fitted to the counterbore 18 and located against shoulder 19. The bore of insert 24 is characterized by a downwardly convergent taper, ranging from an upper diameter D which exceeds the outer diameter D' of the discharge end of a conventional hair dryer, to a lower diameter D'' which is less than diameter D'. It will be understood that the range from diameter D to diameter D'' is desirably sufficient to span the several different values of diameter D' which exist for different commercial hair dryers. Suitably, for example, diameter D may be in the range 45 to 50 mm, and diameter D'' may be in the range 30 to 35 mm.

Figure 3:
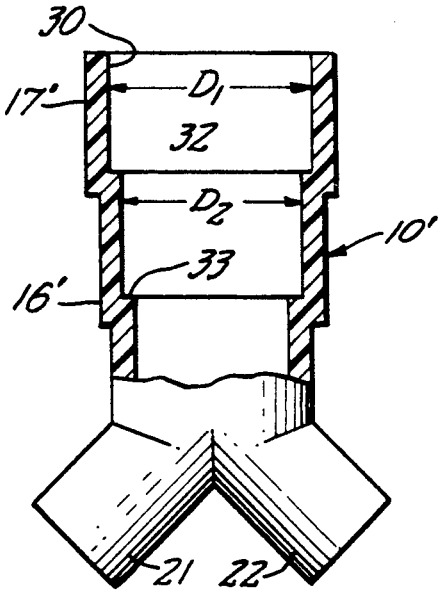
FIG. 3 is a view similar to FIG. 2, to show a modification.

In the modification of FIG. 3, the parts are the same except that, in place of the insert 24 of FIG. 2, the inlet end 17' of fitting 16' is formed with plural counterbores 30, 31 which terminate at progressively reduced shoulder formations 32, 33. The upper counterbore 30 is of larger diameter $D_1$ for sliding telescopic reception of a first-size discharge end of one commercial hair dryer, and the lower counterbore 31 is of lesser diameter $D_2$ for similar sliding reception of another commercial hair dryer.

Regardless of whether one adopts the configuration of FIG. 2 or of FIG. 3, the invention can be sold as a kit for adapting a commercial hair dryer to the drying of ski boots, or other foot wear. The kit simply comprises the "Y" fitting 16 (16') and the two lengths of flexible tubing 12, 13. The kit is readily assembled and disassembled, or, at the user's option, the tubing ends may be adhesively fixed in their counterbores. In either event, the pliable nature of the tubing, and the minimum bulk of the fitting 16 (16') require little of the volume of an overnight kit or bag. In use, one merely holds his hair dryer 11 for downward discharge within the upper end of the fitting 16 (16'), having inserted the lengths 12, 13 of flexible tubing into the individual boots of the pair to be dried, and as indicated the drying job is accomplished in just a few minutes. One thus avoids the time and inconvenience of waiting for and using more publicly available installed boot-drying facilities, exemplified by several of the above-noted prior art systems.

It should go without saying that the described accessory of the invention is equally applicable to the drying of gloves, which may have become soaked in the course of a day's skiing activity.

What is claimed is:

1. Apparatus for use with a portable hair dryer having a tubular discharge end, and for supplying a flow of warm air to a pair of ski boots, comprising an adaptor fitting having a body with a tubular inlet opening and a pair of outlet openings and a communicating passage therebetween, said inlet opening being adapted to internally receive insertion of the discharge end of the hair dryer, and separate lengths of flexible tubing connected to said adaptor at the respective outlet openings, each of said tubing lengths being selected to extend both downwardly into a boot as well as to bend forward with extension at least substantially to the toe end of the interior of a boot, said inlet opening comprising a single counterbore of diameter exceeding that of a dryer discharge end to be used therewith, and an annular insert of flexible yieldable material retained in said counterbore, said insert having a bore which is characterized by a taper which reduces in the direction of dryer flow into said body, said taper ranging from a diameter exceeding that of the dryer discharge end and reducing to a diameter less than that of the dryer discharge end.

2. Apparatus according to claim 1, wherein said lengths of flexible tubing are secured in their connection to said body.

3. Apparatus according to claim 1, wherein said lengths of flexible tubing are removbly connected to said body.

4. Apparatus for use with a portable hair dryer having a tubular discharge end, and for supplying a flow of warm air to a pair of ski boots, comprising an adaptor fitting having a body with a tubular inlet opening and a pair of outlet openings and a communicating passage therebetween, said inlet opening being adapted to internally receive insertion of the discharge end of the hair dryer, and separate lengths of flexible tubing connected to said adaptor at the respective outlet openings, each of said tubing lengths being selected to extend both downwardly into a boot as well as to bend forward with extension at least substantially to the toe end of the interior of a boot, said inlet opening comprising a stepped axial succession of generally cylindrical counterbores of incrementally reducing diameter, the diameter of each counterbore being selected for telescoping reception of a different dryer discharge diameter.

5. Apparatus according to claim 14, wherein a radial shoulder stop is defined at transition from one counterbore to the next-succeeding counterbore.

6. Apparatus according to claim 4, wherein said lengths of flexible tubing are secured in their connection to said body.

7. Apparatus according to claim 4, wherein said lengths of flexible tubing are removably connected to said body.

8. Apparatus for use with a portable hair dryer having a tubular discharge end, and for supplying a flow of warm air to a pair of ski boots, comprising an adaptor fitting having a body with a tubular inlet opening and a pair of outlet openings and a communicating passage therebetween, said inlet opening being adapted to internally receive insertion of the discharge end of the hair dryer, and separate lengths of flexible tubing connected to said adaptor at the respective outlet openings, each of said tubing lengths being selected to extend both downwardly into a boot as well as to bend forward with extension at least substantially to the toe end of the interior of a boot, said inlet opening having a bore which is characterized by a taper which reduces in the direction of dryer flow into said body, said taper ranging from a diameter exceeding that of the dryer discharge end and reducing to a diameter less than that of the dryer discharge end.

9. Apparatus according to claim 8, wherein said lengths of flexible tubing are secured in their connection to said body.

10. Apparatus according to claim 8, wherein said lengths of flexible tubing are removably connected to said body.

* * * * *